US006390837B1

(12) United States Patent
Lee

(10) Patent No.: US 6,390,837 B1
(45) Date of Patent: May 21, 2002

(54) CARD EDGE CONNECTOR WITH SAFETY EJECTOR

(75) Inventor: George Lee, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/745,249

(22) Filed: Dec. 20, 2000

(51) Int. Cl.[7] ..... H01R 13/62
(52) U.S. Cl. ..... 439/160
(58) Field of Search ..... 439/160, 159

(56) References Cited

U.S. PATENT DOCUMENTS 4,846,734 A * 7/1989 Lytle ..... 439/637
5,074,800 A * 12/1991 Sasao et al. ..... 439/157
5,167,517 A * 12/1992 Long ..... 439/160
5,211,568 A * 5/1993 Yamada et al. ..... 439/157
5,302,133 A * 4/1994 Tondreault ..... 439/157
5,364,282 A * 11/1994 Tondreault ..... 439/157
5,634,803 A * 6/1997 Cheng et al. ..... 439/157
6,132,228 A * 10/2000 Lang ..... 439/160

* cited by examiner

*Primary Examiner*—Gary F. Paumen
(74) *Attorney, Agent, or Firm*—WeiTe Chung

(57) ABSTRACT

A card edge connector (10) includes an elongated insulative housing (12) with a central slot (20) for receiving a memory card (100) therein, and two rows of contacts (16) in respective opposite sides of the slot. A pair of cavities (22) is defined in respective opposite ends of the housing, for receiving a pair of corresponding rotatable ejectors (50) therein. Means for preventing over-rotation of the ejectors upon release of the received memory card include a pair of horizontal engaging surfaces (32) at respective opposite ends of the housing and a pair of vertical surfaces (34) provided on the housing adjacent respective horizontal engaging surfaces. The horizontal engaging surfaces abut against respective eject portions (56) of rotated ejectors, thereby preventing over-rotation of the ejectors.

5 Claims, 4 Drawing Sheets

CARD EDGE CONNECTOR WITH SAFETY EJECTOR

BACKGROUND OF THE INVENTION

1. Field of the Invention

The invention relates to a card edge connector, and particularly to a card edge connector having card ejectors on opposite ends thereof and means for preventing such ejectors from over rotation during releasing a card therefrom.

2. The Related Art

Dual In-line Memory Modules (DIMMs) are becoming more and more popular in the computer industry. A DIMM socket connector is mounted on a computer mother board for mechanical and electrical connection to a corresponding DIMM. Typical DIMM connectors are found in U.S. Pat. Nos. 5,074,800, 5,167,517, 5,211,568, 5,302,133 and 5,36, 282. The main distinguishing feature of a typical DIMM connector in comparison with a conventional card edge connector is shown in U.S. Pat. No. 4,846,734. Namely, a DIMM connector generally includes a pair of latch/eject members at respective opposite ends. Thus a DIMM is not only securely retained in the DIMM connector with negligible risk of displacement by vibration or shock, but is also easily ejected from the DIMM connector by rotational movement of the latch/eject members.

However, the latch/eject members can easily be over-rotated, resulting in damage to other components on the mother board. Conventional DIMM connectors have inferior means for preventing the latch/ejector members from being over-rotated. Hence, an improved DIMM connector having such means is desired. An approach has been made by the inventor as shown in U.S. Pat. No. 5,634,803.

SUMMARY OF THE INVENTION

An object of the invention is to provide a card edge connector having not only ejectors at opposite ends thereof for releasably latching a memory card engaged therein but also ejector over-rotation prevention means for ensuring safe ejection of the memory card from the connector.

To obtain the above object, a card edge connector comprises an elongated insulative housing receiving a plurality of contacts therein, and a pair of rotatable ejectors at respective opposite ends of the housing. Each ejector includes an eject portion for releasing a memory card engaged in the connector. The housing includes a pair of the walls, a pair of end walls, and a central slot defined therebetween. The contacts are received in the walls of the housing, and partially extend into the central slot for electrically connecting with the engaged memory card. Each end wall of the housing has an opening at a top portion thereof for receiving the corresponding ejector. The housing further includes a pair of engaging blocks inward from and proximate to the respective eject portions. Each engaging block has a horizontal engaging surface adapted to abut against the eject portion of the corresponding ejector, thereby preventing over-rotation of the ejector.

Other objects, advantages and novel features of the invention will become more apparent from the following detailed descriptionof the present embodiment when taken in conjunction with the accompanying drawings.

DETAILED DESCRIPTION OF THE INVENTION

Figure 1:
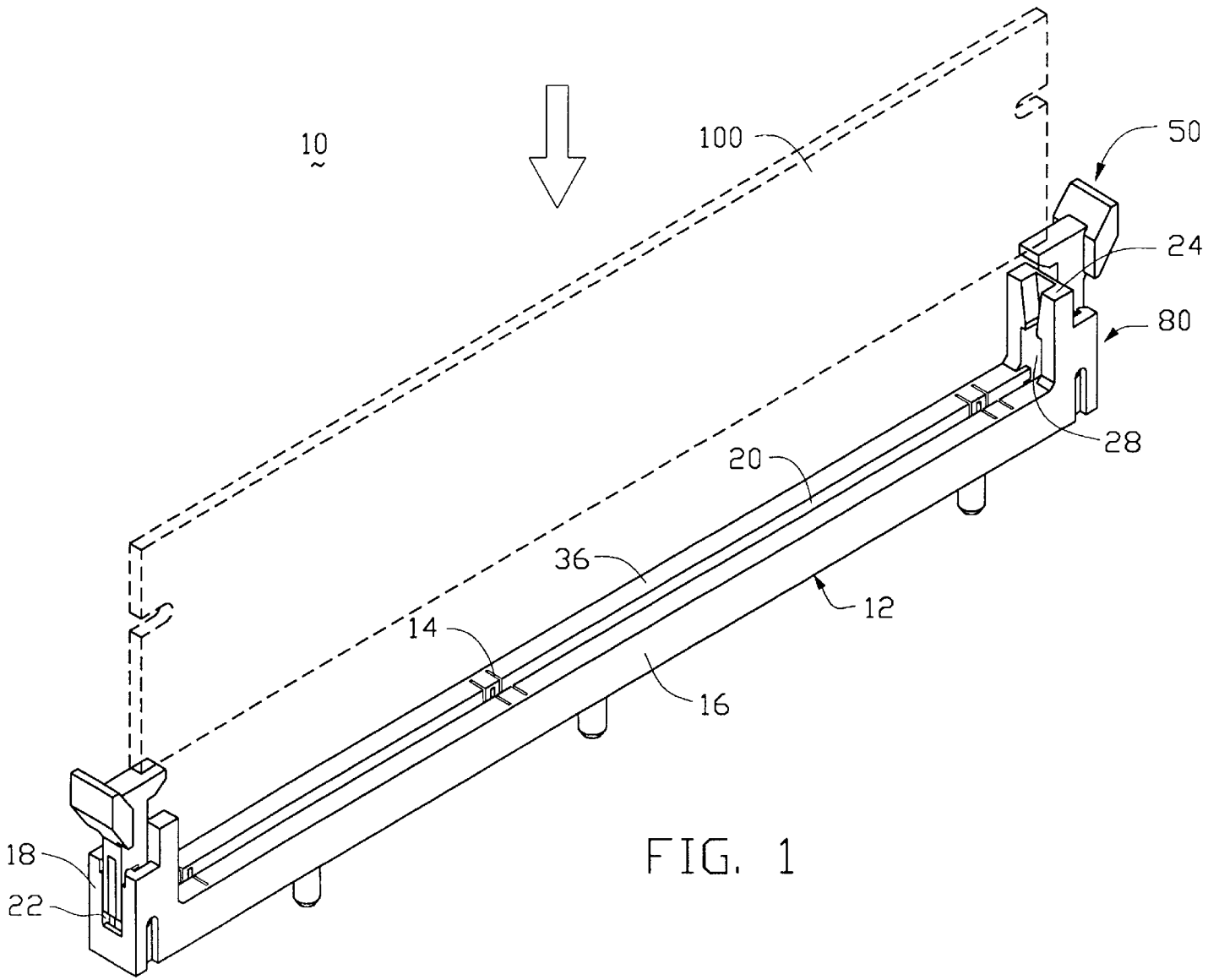
FIG. 1 is a perspective view of a card edge connector of the present invention, together with a memory card for insertion into the connector in the direction of the large arrow.
Figure 2:
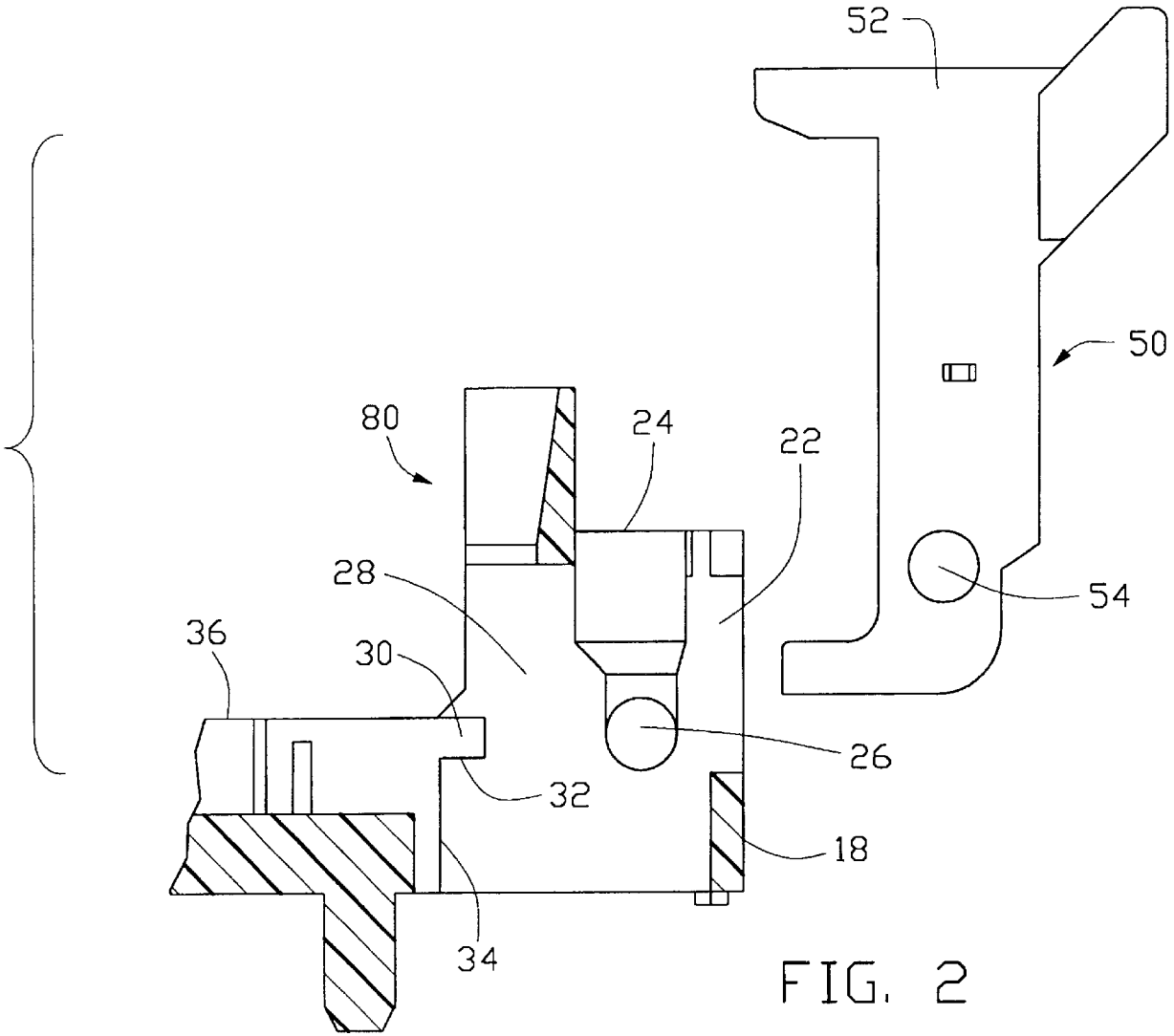
FIG. 2 is a partial cross-sectional view of one end of a dielectric housing of FIG. 1, together with a side view of a corresponding ejector of FIG. 1.

Referring to FIGS. 1–2, a card edge connector 10 of the present invention comprises an elongated insulative housing 12, a plurality of contacts 14 received in the housing 12, and two ejectors 50 rotatably located at opposite ends of the housing 12 for releasing a memory card 100 engaged in the connector 10. The housing 12 includes a pair of towers 80 at respective opposite ends thereof, a pair of end walls 18 at respective towers 80, a pair of side walls 16, a central slot 20 defined between the end walls 18 and side walls 16, and a horizontal mating surface 36 in which the central slot 20 is defined. The contacts 14 are received in the side walls 16, and partially extend into the central slot 20 for electrically connecting to the engaged memory card 100. Each end wall 18 of the housing 12 has an opening 22 defined in a top portion 24 thereof, for entrance of the corresponding ejector 50. Each tower 80 defines a cavity 28 therein. Each cavity 28 communicates with the adjacent opening 22 and the central slot 20 of the housing 12, for accommodating the ejector 50. Each side wall 16 defines a through hole 26 for rotatably retaining the ejector 50, which is well known in the art. Each ejector 50 comprises a lever 52 for rotatable operating the ejector, a pair of pivots 54 at respective opposite sides of a bottom portion of the lever 52, and an eject portion 56 extending perpendicularly inwardly from a bottom end of the lever 52. The eject portion 56 extends from an inner surface 58 toward the central slot 20 of the housing 12 (FIG. 4).

Referring particularly to FIG. 2, the housing 12 forms a pair of engaging blocks 30 at respective opposite ends thereof. The pair of engaging blocks 30 each are proximate to the eject portions 56 of corresponding ejectors 50 of the housing 12. Each engaging block 30 has a generally horizontal engaging surface 32 adapted to abut against the corresponding ejector 50, and a vertical surface 34 adapted to allow rotation of the ejector 50.

Figure 3:
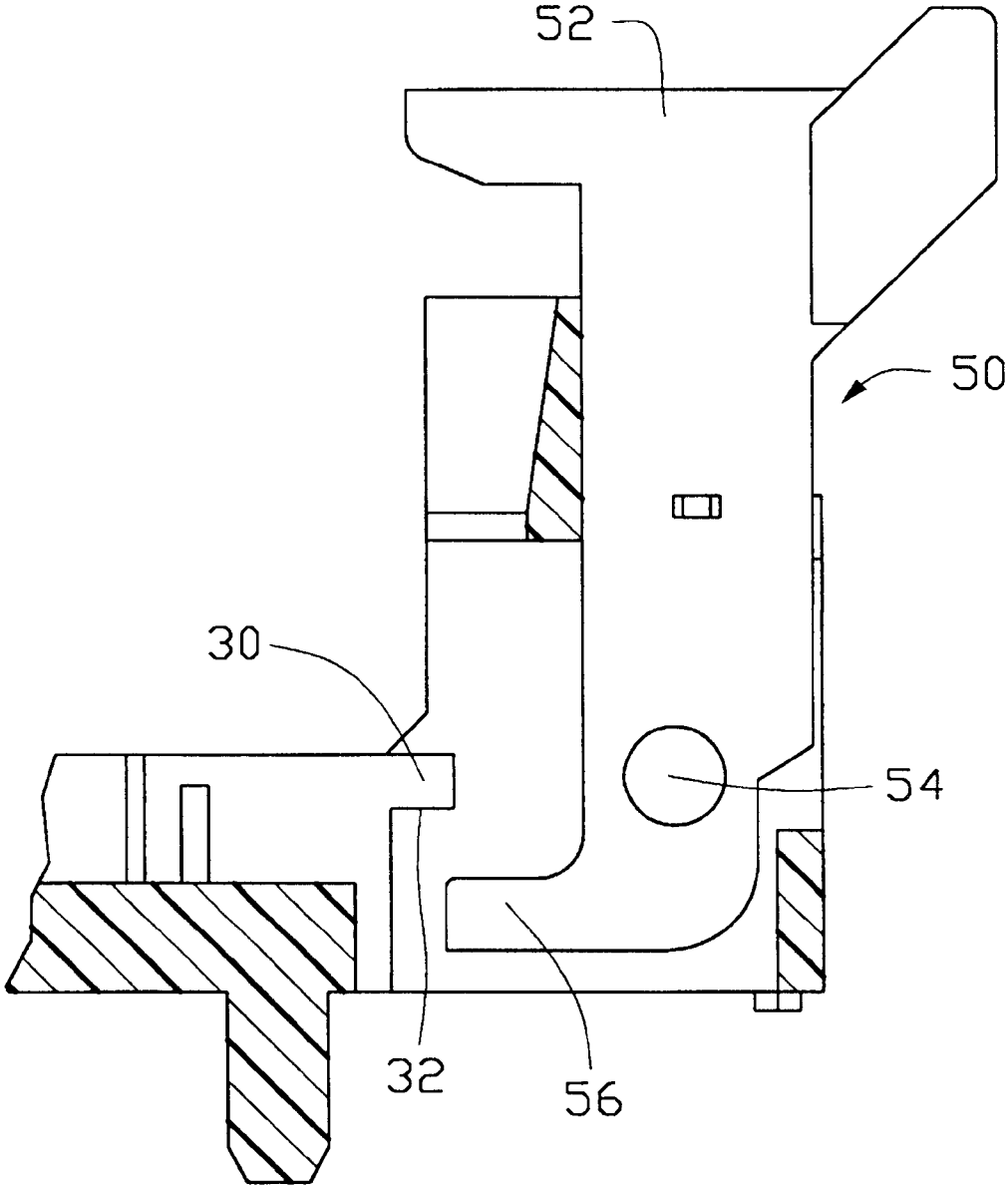
FIG. 3 is similar to FIG. 2, but with the ejector attached to the housing at an upright position.
Figure 4:
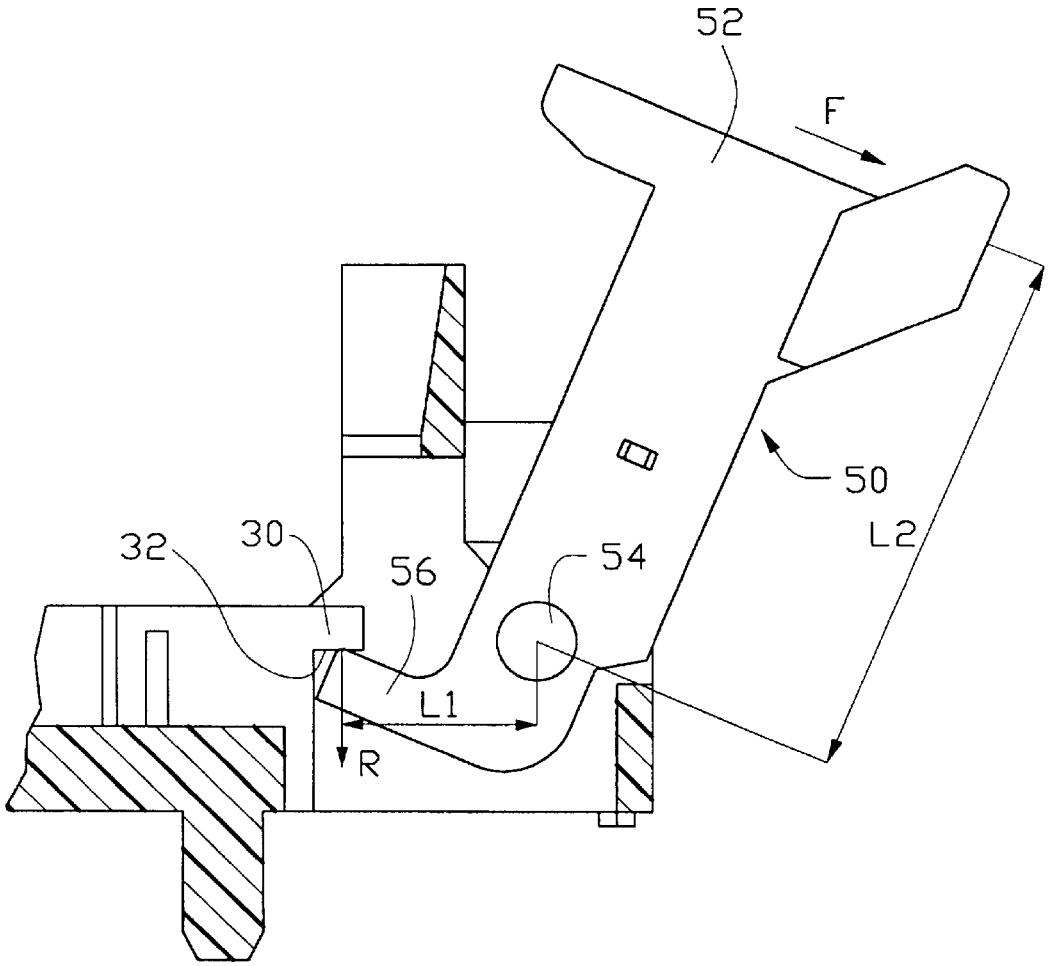
FIG. 4 is similar to FIG. 3, but with the ejector rotated as far as it can go.

Referring also to FIGS. 3–4, in assembly, the pair of ejectors 50 is inserted via the openings 22 into the respective cavities 28 of the towers80. The ejectors 50 are moved downwardly until the pivots 54 are rotatably received in the corresponding through holes 26 of the housing 12. The eject portion 56 of each ejector 50 is located in a lower portion of the cavity 28. Each engaging block 30 prevents the corresponding ejector 50 from over-rotating.

In FIG. 4, given the engaging surface 32 is horizontal, a resistance force R acts downwardly on the eject portion 56 of the ejector 50. A resistance length L1 is defined between the point of resistance force R and the center of the pivots 54. An operation force F acts at the upper extremity of the lever 52. An operation length L2 is defined between the operation force F and the center of the pivots 54. In equilibrium, $R*L1=F*L2$; therefore, $R=F*L2/L1$. From this equation, we can see that the resistance force R is inversely proportional to the resistance length L1. Thus when L1 is large, R is small, and the engaging blocks 30 can prevent the ejectors 50 from over-rotating with minimal risk of damage being caused to the apparatus.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A card edge connector comprising:

an elongated insulative housing including a mating surface, a pair of side walls and a pair of end walls, and a central slot defined between the side walls and the end walls for receiving a memory card therein, each end wall defining an opening at a top portion thereof;

a plurality of contacts received in the side walls of the housing and partially extending into the central slot for electrically contacting the memory card; and at least one card ejector at one end of the housing for safely releasing the memory card from the connector, the at least one card ejector having an operation lever and a card eject portion at a bottom end of the operation lever, the card eject portion extending from an inner surface of the operation lever toward the central slot of the housing;

wherein the housing further includes an engaging block proximate to the eject portion of the at least one card ejector, the engaging block having a horizontal engaging surface downwardly abutting against the eject portion to limit rotation of the ejector.

2. The card edge connector as defined in claim 1, wherein the engaging block further includes a vertical surface perpendicular to the horizontal engaging surface, the vertical surface being adapted to allow rotation of the ejector.

3. An electrical connector comprising:

an elongated insulative housing defining a central slot in a mating surface thereof adapted to receive an electronic card therein;

a plurality of contacts received in the housing, for electrical and mechanical engagement with the electronic card in the housing;

at least one card ejector at one end of the housing for safely releasing the electronic card from the connector, the at least one card ejector having an operation lever and a card eject portion at a bottom end of ;the operation lever, the card eject portion extending from an inner surface of the operation lever toward the central slot of the housing; and at least one tower formed at one end of the housing, each tower defining a cavity for receiving the at least one card ejector therein;

wherein the housing further includes an engaging block at the at least one tower, the engaging block having an engaging surface generally parallel to the mating surface of the housing and downwardly abutting against the card eject portion of the at least one card ejector to limit rotation of the at least one card ejector.

4. The electrical connector as defined in claim 3, wherein the mating surface of the housing and the engaging surface of the engaging block are generally horizontal.

5. The electrical connector as defined in claim 4, wherein each engaging block further includes a vertical surface perpendicular to the engaging surface, the vertical surface being adapted to allow rotation of the at least one ejector.

* * * * *